United States Patent [19]

Vanassche et al.

[11] 4,023,972

[45] May 17, 1977

[54] METHOD OF PREPARING A BLEND OF FOGGED, DIRECT-POSITIVE SILVER HALIDE EMULSIONS OF DIFFERENT AVERAGE GRAIN SIZES

[75] Inventors: Willy Joseph Vanassche, Kontich; Herman Alberik Pattyn, Kapellen, both of Belgium

[73] Assignee: AGFA-GEVAERT N.V., Mortsel, Belgium

[22] Filed: June 7, 1974

[21] Appl. No.: 477,210

[30] Foreign Application Priority Data

June 18, 1973 United Kingdom ..... 28769/73

[52] U.S. Cl. ..... 96/101; 96/120; 96/107; 96/108

[51] Int. Cl.[2] ..... G03C 1/36; G03C 1/28

[58] Field of Search ..... 96/107–108, 96/101, 120, 67, 64

[56] References Cited

UNITED STATES PATENTS

| | | | |
|---|---|---|---|
| 3,367,778 | 2/1968 | Berriman | 96/107 |
| 3,531,290 | 9/1970 | Litzerman | 96/101 |
| 3,615,573 | 10/1971 | Smith et al. | 96/64 |
| 3,615,610 | 10/1971 | Florens et al. | 96/101 |

FOREIGN PATENTS OR APPLICATIONS

| | | | |
|---|---|---|---|
| 1,186,718 | 4/1970 | United Kingdom | 96/107 |
| 1,287,425 | 8/1972 | United Kingdom | 96/67 |

*Primary Examiner*—Won H. Louie, Jr.
*Attorney, Agent, or Firm*—A. W. Breiner

[57] ABSTRACT

A method is described of preparing a blend of direct-positive silver halide emulsions that has a pAg value of at least 8.35 from two or more direct-positive silver halide emulsions of different average grain-sizes comprising fogged silver halide grains and having pAg values below 8.35, without inducing physical ripening, by raising the pAg to the value of at least 8.35 before or after blending the emulsions, and providing at least one electron-accepting or halogen-conducting compound, at the surface of the fogged silver halide grains prior to raising the pAg to the value of at least 8.35.

12 Claims, No Drawings

METHOD OF PREPARING A BLEND OF FOGGED, DIRECT-POSITIVE SILVER HALIDE EMULSIONS OF DIFFERENT AVERAGE GRAIN SIZES

The present invention relates to a method of preparing blends of direct-positive silver halide emulsions.

It is known that direct-positive images can be obtained with certain types of photographic silver halide emulsions withtout previously forming a negative silver image. For this purpose, the silver halide grains are fogged, before or after coating on a support, by an overall exposure to actinic radiation or by overall chemically fogging e.g. by means of reducing agents. Upon image-wise exposure of the prefogged emulsions, the development centres formed by said fogging are destroyed at the exposed areas and remain at the unexposed areas. By subsequent conventional development by means of silver halide developers a direct-positive image is formed.

In direct-positive image formation, the developable silver specks formed by fogging are destroyed (bleached) in the exposed areas which can be represented schematically as follows:

$$Br^{-h\gamma} \rightarrow Br + e$$
$$Br + Ag^{*} \rightarrow Br^{-} + Ag^{+}$$

($e$ = photoelectron, $Ag^{*}$ = developable silver speck).

In the interest of sensitivity recombination of photoelectrons with positive holes (bromide ion that has lost an electron) should be avoided. Therefore, direct-positive silver halide emulsions are preferably of the kind comprising electron traps.

As is known in the art, direct-positive emulsions may comprise interior electron traps or exterior electron traps.

Direct-positive silver halide emulsions with interior electron-traps are emulsions comprising silver halide grains having in their interior centres promoting the deposition of photolytic silver and an outer region of silver halide which is fogged. As described in U.S. Pat. No. 3,537,858 of Albert W. Wise issued Nov. 3, 1970 these direct-positive emulsions with interior electron traps preferably comprise adsorbed to the surface of the fogged silver halide grains, halogen-conducting compounds having an anodic polarographic halfwave potential less than 0.85 and a cathodic polarographic half-wave potential more negative than −1.0.

Direct-positive silver halide emulsions with exterior electron-traps are emulsions have adsorbed to the surface of the fogged silver halide grains one or more compounds accepting electrons preferably electron-accepting dyes. Formerly such compounds were called desensitizers because dyes having a desensitizing effect in negative emulsions were particular suitable for use in direct-positive emulsions (cfr. British Pat. No. 723,019 filed Feb. 5, 1952 by Gevaert Photo-Producten N.V.).

According to Sheppart et al, J. Phys. Chem. 50 (1946) 210, Stanienda, Z. Phys. Chem. (NF) 32 (1962) 238, and Dahne, Wiss. Phot. (1961) 161, desensitizers were dyestuffs with a cathodic polarographic half-wave potential more positive than −1.0. Now, it is common practice to characterize the electron-acceptors for direct-positive emulsions as having an anodic polarographic half-wave potential and a cathodic polarographic half-wave potential that when added together give a positive sum. They are usually dyes and preferably but not necessarily provide spectral sensitization.

In order to improve the photographic characteristics of silver halide emulsions it is known to increase the pAg of the emulsions before coating e.g. by addition of water-soluble halides. In the Phot. Korr., Band 96, No. 3, 1960 p. 35–39 Hautot and Sauvenier have shown that reversal of fogged silver bromide and silver bromoiodide emulsions is promoted by addition of a desensitizer (=electron acceptor) and potassium bromide and according to U.S. Pat. No. 3,531,290 of Roberta A. Litzerman issued Sept. 29, 1970 fogged silver halide emulsions comprising at least 50 mole % of silver chloride show increased sensitivity and maximum density by addition of water-soluble bromides and iodides together with a halogen conducting or electron accepting compound characterized by the above polarographic half-wave potentials.

When it is the intention to obtain special photographic characteristics in a single emulsion e.g. extended exposure latitude, reduced gradation, etc. by blending two or more silver halide emulsions, the silver halide grains of which have different average grain sizes, increasing the pAg of the emulsion blend e.g. to a value of 8.35 or higher tends to induce physical or Ostwald ripening. This results in unpredictability and non-uniformity of the photographic characteristics of the emulsion blend from batch to batch or from the first-coated portion to the last coated portion of the emulsion blend.

According to British Pat. No. 1,287,425 filed Oct. 30, 1969 by Eastman Kodak Co. photographic elements are provided comprising a silver halide emulsion layer composed of a blend of photographic silver halide emulsions of different average grain sizes wherein the pAg of the emulsion blend is increased without modification of the silver halide grainsize distribution i.e. without physical ripening so that the mixture retains the intended combination of properties of the initial emulsions. For this purpose, a layer comprising water-soluble halide is provided adjacent to the silver halide emulsion layer whereby before coating the mixture of silver halide emulsions can have a relatively low pAg value, when little or no physical ripening occurs, which is increased after coating by the said layer comprising water-soluble halide.

It has now been found that a blend of two or more direct-positive silver halide emulsions comprising fogged silver halide grains of different average grain-size that has a pAg value of at least 8.35 can be obtained without any substantial change in grain-size distribution by physical or Ostwald ripening and thus with maintenance of favourable photographic sensitometric characteristics of the initial emulsion when the fogged silver halide grains of the emulsions have adsorbed to the surface thereof electron-accepting compounds or halogen-conducting compounds as referred to hereinbefore and provided that the said compounds were added before the pAg was adjusted to the value of 8.35 or higher.

It has further been found that adjusting the pAg to the value of 8.35 or higher after blending of the separate emulsions favours the maximum density of the emulsion blend whereas adjusting the pAg of the separate emulsions to the value of 8.35 or higher before blending favours the sensitivity of the emulsion blend.

The present invention therefore provides a method of preparing a blend of direct-positive silver halide emulsions that has a pAg of at least 8.35 by blending two or more direct-positive silver halide emulsions of different average grain sizes comprising fogged silver halide grains and having pAg values below 8.35, raising the pAg to a value of at least 8.35 before or after blending the emulsions, and providing at least one electron-accepting or halogen-conducting compound at the surface of the fogged silver halide grains prior to raising the pAg to the value of at least 8.35.

According to one embodiment of the method of the present invention, the separate direct-positive silver halide emulsions to be blended are provided at the surface of the fogged silver halide grains with at least one electron accepting or halogen conducting compound whereupon the pAg values of the separate emulsions are raised to the pAg value of at least 8.35 and the emulsions are then admixed to form the emulsion blend.

According to a preferred embodiment of the method of the invention the separate direct-positive silver halide emulsions to be blended are provided at the surface of the fogged silver halide grains with at least one electron accepting or halogen conducting compound whereupon the separate emulsions are admixed to form an emulsion blend and the pAg of the emulsion blend is raised to the value of at least 8.35.

According to the favoured embodiment of the method of the invention the two or more direct-positive silver halide emulsions of different average grain-sizes containing fogged silver halide grains and pAg values below 8.35 are first admixed whereupon at least one electron-accepting or halogen conducting compound is provided at the surface of the fogged silver halide grains of the emulsion blend and the pAg of the emulsion blend is raised to the value of at least 8.35. The latter embodiment is the most convenient method in that the various steps in the preparation of the emulsion blend are reduced to a minimum; the addition of electron acceptor(s) or halogen conductor(s) as well as raising the pAg occurs with the emulsion blend and not with the separate emulsions.

According to the method of the invention the blend of direct-positive silver halide emulsions, which is coated on a support, has a pAg-value of at least 8.35, preferably a pAg-value in the range from about 9 to about 11, most preferably in the range from about 9.6 to about 10.2. The direct-positive silver halide emulsions to be blended have a pAg-value below 8.35, preferably a pAg in the range from about 5 to about 7.7.

Generally, any water-soluble compound forming water-insoluble silver salts or silver complexes can be used to raise the pAg of the emulsions or emulsion blends. Typical useful compounds are halides which include ammonium, alkali metal e.g. potassium, sodium or lithium, cadmium and strontium halides, preferably bromides and/or iodides. Other compounds yielding bromide and/or iodide ions in aqueous medium are also suitable for the purpose.

In addition to raising the pAg of the separate emulsions or the emulsion blend according to the method of the present invention after the fogged silver halide grains have been provided at the surface thereof with at least one electron-accepting and/or halogen conducting compound, it may be advantageous to lower the pH, preferably to a value below 6.5 and most preferably to a value of about 5 as described in Belgian Pat. No. 802,056 filed July 9, 1973 by Agfa-Gevaert N.V., in order to obtain increased speed and high stability.

As is referred to hereinbefore, it is known to characterize electron-accepting compounds and halogen conducting compounds by means of their polarographic half-wave potential. The electron-acceptors have an anodic polarograpic half-wave potential and a cathodic polarographic half-wave potential that when added together give a positive sum.

The halogen conducting compounds have an anodic polarographic half-wave potential less than 0.85 and a cathodic polarographic half-wave potential which is more negative than −1.0. Methods of determining these polarographic half-wave potentials have been described e.g. in U.S. Pat. Nos. 3,501,310 of Bernard D. Illingsworth issued Mar. 17, 1970 and 3,531,290 as mentioned above. The compounds preferably have spectrally sensitizing properties although it is possible to use electron-accepting compounds that do not spectrally sensitize the emulsions.

Particularly useful classes of electron accepting compounds which can be used in the method of the present invention are nitrostyryl and nitrobenzylidene dyes as described in U.S. Pat. No. 3,615,610 of Raymond Leopold Florens, Johannes Gotze, August Randolf Theofiel Hubert Ghys issued Oct. 26, 1971 and which can be represented by the following general formulae I to IV:

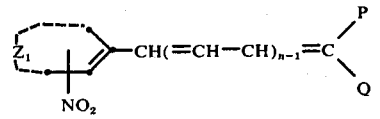

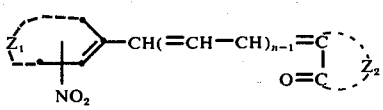

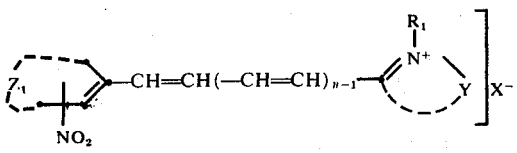

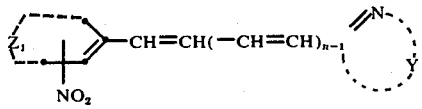

wherein one or more of the methine groups may be substituted e.g. with a cyano group, $R_1$ represents a substituent as commonly employed in cyanine dyes, especially a saturated or unsaturated aliphatic hydrocarbon group including such substituted group e.g. alkyl including substituted alkyl e.g. methyl, ethyl, propyl, butyl, β-hydroxyethyl, β-acetoxyethyl, sulphoethyl, sulphopropyl, sulphatopropyl, sulphatobutyl, carboxyethyl, carboxybutyl, cyanoethyl, a group —ACOOBSO$_2$OH wherein each of A and B represents a hydrocarbon group as described in the United Kingdom Pat. No. 886,271 filed June 20, 1971 by Gevaert Photo-Producten N.V. or the group —A—W—NH—V—B, wherein A represents methylene, ethylene, propylene, or butylene, B represents alkyl, amino, substituted amino or if V is a single bond hydrogen, and each of W and V represents carbonyl, sulphonyl or a single bond, but at least one of them being sulphonyl as described in United Kingdom Pat. No. 904,332 filed July 5, 1957 by Gevaert Photo-Producten N.V., a cycloalkyl group e.g. cyclohexyl and allyl, an aliphatic-aromatic hydrocarbon group including such substituted group e.g. benzyl and carboxybenzyl, an aromatic hydrocarbon group e.g. aryl including substituted aryl e.g. phenyl and carboxyphenyl, $X^-$ represents an anion e.g. chloride, bromide, iodide, perchlorate, methylsulphate, p-toluene sulphonate, etc. but is not present when $R_1$ itself contains an anionic group, Y represents the atoms necessary to complete a heterocyclic nucleus of the type used in the production of cyanine dyes e.g. those of the thiazole, benzothiazole and naphthothiazole series, those of the oxazole, benzoxazole, andnaphthoxazole series, those of the selenazole, benzoselenazole, and naphthoselenazole series, those of the thiadiazole series, those of the 2-quinoline series, those of the pyrimidine series, those of the quinoxaline series, those of the quinazoline series, those of the 1-phthalazine series, those of the 2-pyridine series and those of the benzimidazole series, $Z_1$ represents the necessary atoms to close an aromatic nucleus e.g. a benzene nucleus, which may be further substituted e.g. with another nitro group, each of P and Q represents an organic group with electronegative character e.g.

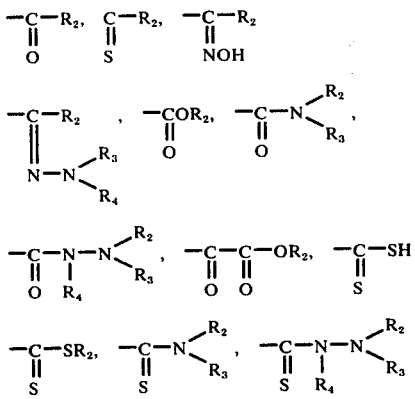

(wherein each of $R_2$, $R_3$ and $R_4$ represents a hydrogen atom, an alkyl group, an aryl group, an aralkyl group, or a heterocyclic group, which groups may be substituted), $-NO_2$, —CN, an aromatic homocyclic monovalent group e.g. phenyl or naphthyl, which group may be substituted preferably with an electronegative group as hereinbefore described or a monovalent heterocyclic group with aromatic character e.g. a furyl, thienyl, pyrrolyl, indolyl, or

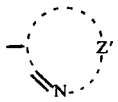

group, wherein Z′ represents the necessary atoms to close a heterocyclic nucleus with aromatic character, which groups may be substituted, $Z_2$ represents the necessary atoms to close a cyclic ketomethylene nucleus such as one of those of the pyrazolone series e.g. 3-methyl-1-phenyl-5-pyrazolone, 1-phenyl-5-pyrazole, 1-(2-benzothiazolyl)-3-methyl-5-pyrazolone, those of the isoxazolone series e.g., 3-phenyl-5-isoxazolone, or 3-methyl-5-isoxazolone, those of the oxindole series, e.g. 1-alkyl-2,3-dihydro-2-oxindoles, those of the 2,4,6-triketohexahydropyrimidine series e.g. barbituric acid or 2-thiobarbituric acid as well as their derivatives such as those substituted in the 1-position by an alkyl group such as a methyl group, an ethyl group, an 1-n-propyl group, and a 1-n-heptyl group, or those substituted in the 1- and 3-position by an alkyl group, or those substituted in the 1- or 3-position by a β-methoxyethyl-group, or those substituted in the 1- and 3-position by an aryl group such as phenyl group, or those substituted in the 1- and 3-position by a substituted phenyl group such as a p-chlorophenyl group, or a p-ethoxycarbonyl-phenyl group, or those substituted only in the 1-position by a phenyl-, p-chlorophenyl-, or p-ethoxycarbonylphenyl group, further the mixed alkyl-aryl-substituted derivatives such as 1-ethyl-3-phenyl, and 1-n-heptyl-3-phenyl derivatives, those of the rhodanine series i.e., 2-thio-2,4-thiazolidinedione series, e.g. rhodanine, and aliphatically substituted rhodanines, e.g., 3-ethyl-rhodanine, or 3-allylrhodanine, those of the imidazo [1,2-a]pyridone series, those of the 5,7-dioxo-6,7-dihydro-5-thiazole[3,2-a]pyrimidine series e.g. 5,7-dioxo-3-phenyl-6,7-dihydro-5-thiazolo[3,2-a]pyrimidine, those of the 2-thio-2,4-oxazolidinedione series i.e. those of the 2-thio-2,4-oxazoledione series e.g. 3-ethyl-2-thio-2,4-oxazolidinedione, those of the thianaphthenone series e.g. 3-thianaphthenone, those of the 2-thio-2,5-thiazolidinedione series i.e. the 2-thio-2,5-thiazoledione series e.g. 3-ethyl-2-thio-2,5-thiazolidinedione, those of the 2,4-thiazolidinedione series e.g. 2,4-thiazolidinedione, 3-ethyl2,4-thiazolidinedione, 3-phenyl-2,4-thiazolidinedione, 3-α-naphthyl-2,4-thiazolidinedione, those of the thiazolidone series e.g. 4-thiazolidone, 3-ethyl-4-thiazolidone, 3-phenyl-4-thiazolidone, 3- α-naphthyl-4-thiazolidone, those of the 4-thiazolone series e.g. 2-ethylmercapto-4-thiazolone, 2-alkylphenylamino-4-thiazolones, 2-diphenylamino-4-thiazolone, those of the 2-imino-2,4-oxazolinone i.e. pseudohydantoin series, those of the 2,4-imidazolinedione (hydantoin) series e.g. 2,4-imidazolinedione, 3-ethyl-2,4-imidazolinedione, 3-phenyl-2,4-imidazolinedione, 3-α-naphthyl-2,4-imidazolinedione, 1,3-diethyl-2,4-imidazolinedione, 1-ethyl-3-phenyl-2,4-imidazolinedione, 1-ethyl-3-α-naphthyl-2,4-imidazolinedione, 1,3-diphenyl-2,4-imidazolinedione, those of the 2-thio-2,4-imidazolinedione (i.e. 2-thiohydantoin) series, e.g., 2-thio-2,4-imidazolinedione, 3-ethyl-2-thio-2,4-imidazolinedione, 3-phenyl-2-thio-2,4-imidazolinedione, 3-α-naphthyl-2-thio-2,4-imidazolinedione, 1,3-diethyl-2-thio-2,4-imidazolinedione, 1-ethyl-3-phenyl-2-thio-2,4-imidazolinedione, 1-ethyl-3-α-naphthyl-2-thio-2,4-imidazolinedione, 1,3-diphenyl-2-thio-2,4-imidazolinedione, those of the 5-imidazolone series e.g. 2-n-propylmercapto-5-imidazolone, and those of the homocyclic ring systems represented by the following structural formulae:

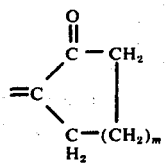

wherein $m$ represents 1, 2, or 3,

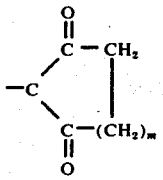

wherein $m$ represents 1, 2, or 3,

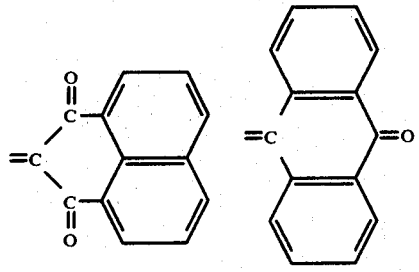

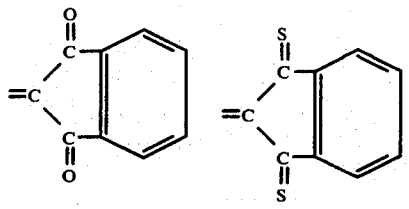

or

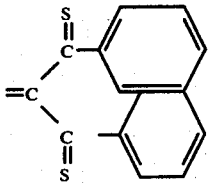

$n$ represents a positive integer 1 or 2.

Other very suitable electron-accepting compounds for use in the method according to the present invention are the dihydropyrimidine compounds of U.S. patent application Ser. No. 269,861 filed July 7, 1972 of Willy Joseph Vanassche, Robert Joseph Pollet, Hendrik Alfons Borginon and Herman Alberik Pattyn (=published German Patent Application No. 2,237,036 filed July 28, 1972 by Agfa-Gevaert AG) which correspond to one of the following general formlae V or VI or a tautomeric form thereof:

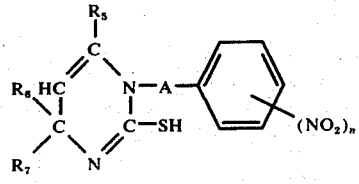

V.

-continued

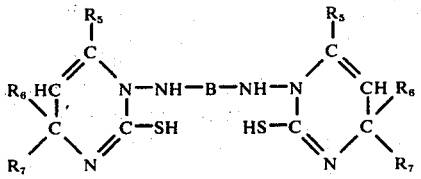

VI.

wherein:

$R_5$ is hydroxyl or $C_1$–$C_5$ alkyl, $R_6$ is hydrogen or $C_1$–$C_5$ alkyl, $R_7$ is $C_1$–$C_5$ alkyl or aryl, A is a single bond or NH, B is a phenyl or diphenyl sulphone group in which one or both phenyl groups are substituted with one or more nitro groups, and $n$ is 1, 2 or 3.

As is known from this United States Patent Application the compounds corresponding to the above general formulae V and VI are not only suitable for use as such but it is also possible to use the corresponding disulphides thereof or precursor compounds e.g. compounds corresponding to the above general formulae V or VI or a tautomeric form thereof wherein the tautomeric hydrogen atom is replaced by a —COR′ group in which R′ represents alkyl, aryl, aralkyl or a residue identical to the diazine residue linked to the carbonyl group of —COR′, by a —$SO_2$R″ group in which R″ is alkyl, aryl or aralkyl or by a COOR‴ group wherein R‴is alkyl or aryl.

Other useful electron acceptors are dyes of the type referred to in U.S. Pat. No. 3,531,290 as mentioned above which is incorporated herein be reference. These dyes include e.g. the symmetrical imidazo[4,5-b]quinoxaline cyanine dyes of Belgian Pat. No. 660,253 filed Feb. 25, 1965 by Kodak Co., the symmetrical trimethine dyes with 2-aromatically e.g. 2-phenyl substituted indole nuclei of U.S. Pat. No. 2,930,694 of Russell Pearce Heuer issued Mar. 29, 1960 unsymmetrical dimethine dyes with a 2-aromatically substituted indole nucleus and a desensitizing nucleus e.g. an imidazo[4,5-b] quinoxaline nucleus and a pyrrole[2,3-b]pyrido nucleus, trimethine dyes with a pyrrolo[2,3-b]pyrido nucleus and a desensitizing nucleus e.g. 6-nitrobenzthiazole nucleus, 5nitroindolenine nucleus, imidazo[4,5-b]quinoxaline nucleus and pyrrolo[2,3-b]pyrido nucleus, and dimethine dyes containing a pyrazolyl and an imidazo[4,5-b]quinoxaline nucleus.

Other useful electron acceptors are cyanine and merocyanine dyes in which at least one nucleus, and preferably two nuclei contain desensitizing substituents such as nitro groups.

Specific examples of electron acceptors suitable for use in accordance with the method of the present invention are phenosafranine, pinacryptol, crystal violet, 1-ethyl-2-m-nitrostyryl-quinolinium bromide, 2-m-nitrostyryl quinoline, 1-methyl-2-m-nitrostyryl-quniolinium methylsulphate, 5-m-nitrobenzylidene-rhodanine, 3-phenyl-5-m-nitrobenzylidenerhodanine, 3-ethyl-5-m-nitrobenzylidene-rhodanine, 3-ethyl-5-(2,4-dinitrobenzylidene)rhodanine, 3-phenyl-5-o-nitrobenzylidene-rhodanine, 1-(2,4-dinitroanilino)-4,4,6-trimethyldihydropyrimidine-2-thione, 1,1′-dimethyl-2,2′-diphenyl-3,3′-indolocarbocyanine bromide, 1,1′-dimethyl-2,2′-di(p-methoxyphenyl)-3,3′-indolocarbocyanine bromide, 1,1′-dimethyl-2,2′,8-triphenyl-3,3′-indolocarbocyanine perchlorate, 1,1′,3,3′-tetraethylimidazo[4,5-b]quinoxaline carbocyanine chloride, 1,3-diethyl-1'-methyl-2'-phenyl-imidazo[4,5-b]quinoxalino-3'-indolocarbocyanine iodide, 6-chloro-1'-methyl-1,2',3-triphenyl-imidazo[4,5-b']-quinoxalino-3'-indolocarbocyanine-p-toluene sulphonate, 1,1',3,3'-tetramethyl-2-phenyl-3-indolopyrrolo[2,3-b]pyridocarbocyanine iodide, 1,1',3,3,3',3'-hexamethyl-pyrrolo[2,3-b]pyrido carbocyanine perchlorate, 5,5'-dichloro-3,3'-diethyl-6,6'-dinitrothiacarbocyanine iodide, 1,3-dialkyl-2-[2-(3,5-dimethyl-1-phenyl-4-pyrazolyl)vinyl] imidazo[4,5-b]quinoxalinium iodide, 1',3-diethyl-6-nitrothia-2'-cyanine iodide, 3,3'-diethyl-6,6'-dinitrothiacarbocyanine ethyl sulphate, 3,3'-di-p-nitrobenzyl thiacarbocyanine iodide, 3,3'-di-o-nitrophenylthiacarbocyanine perchlorate, 4-nitro-6-chlorobenzotriazole, 2,3,5-triphenyl-2H-tetrazolium chloride, 2-(4-iodophenyl)-3-(4-nitrophenyl)-5-phenyl tetrazolium chloride, 1-methyl-8-nitroquinolinium methyl sulphate, 1-m-nitrobenzyl-quinolinium chloride, 1-m-nitrobenzylpyridinium chloride, 1-p-nitrobenzyl-isoquinolinium chloride, 1-p-nitrobenzylbenzo[f-]quinolinium chloride, anhydro-2-p-dimethylamino-phenyliminoethyl-6-nitro-3(4-sulphobutyl)benzothiazolium hydroxide, 1,3-diamino-5-methylphenazinium chloride, etc.

Halogen-conducting compounds particularly suitable for use in the method according to the present invention are dimethine and tetramethine merocyanine dyes wherein the methine chain links a 5- or 6-membered nitrogen-containing heterocyclic nucleus e.g. of the oxazole series, of the thiazole series, of the selenazole series of the benzoxazole series, of the benzothiazole series, of the benzoselenazole series, of the naphthoxazole series, of the naphthothiazole series, of the naphthoselenazole series, of the thiazoline series, of the quinoline series, of the pyridine series, of the 3,3-dialkylindolenine series, etc. to a heterocyclic ketomethylene nucleus of the type represented by $Z_2$ is general formula II hereinbefore e.g. a rhodanine nucleus, a 2-thiohydantoine nucleus, a 2-thio-2,4-oxazoledione nucleus, a 2-thio2,4-thiazole-dione nucleus, a 5-pyrazolone nucleus, etc. Representative examples of suitable halogen-conducting merocyanine dyes can be found in U.S. Pat. No. 3,531,290 as mentioned hereinbefore which is incorporated herein by reference.

The halogen-conducting as well as the electron-accepting compounds can be incorporated into the separate silver halide emulsions or the emulsion blend according to methods well known to those skilled in the art of emulsion making e.g. from solutions in appropriate solvents such as water, methanol, ethanol, pyridine, etc. or mixtures of solvents. They can be used in widely varying concentrations. Generally amounts varying from about 50 mg to about 2 g, preferably from about 200 mg to about 1 g, are used per mole of silver halide.

In a preferred embodiment of the method of the present invention an emulsion blend is prepared of at least two direct-positive silver halide emulsions wherein the average grain-size of one emulsion is at least 50% greater, and preferably at least 100% greater, than the average grain-size of another emulsion.

The separate direct-positive silver halide emulsions generally have a mean grain diameter i.e. an average grainsize of less than than 2 $\mu$m, preferably in the range from about 0.2 $\mu$m to about 1 $\mu$m.

Particle size of silver halide grains can be determined using conventional methods e.g. as described by Trivelli and Smith, The Photographic Journal, Vol. 69, 1939, p.330–338, Loveland, "ASTM symposium on light microscopy", 1953, p.94–122 and Mees and Jones, "The Theory of the photographic process" (1966), Chapter II.

The silver halides of the separate direct-positive silver halide emulsions may be silver chloride, silver bromide, silver chlorobromide, silver chloroiodide, silver bromoiodide and silver chlorobromoiodide. The silver halide grains may be regular and may have any of the known shapes e.g. cubic, octahedral or even rhombohedral as described in Belgian Pat. No. 782,893 filed May 2, 1972 by Agfa-Gevaert N.V. The preferred shape is cubic.

The emulsion blend may be a blend of monodispersed silver halide emulsions, a blend of heterodispersed silver halide emulsions or a blend of monodispersed and heterodispersed silver halide emulsions.

Monodispersed silver halide emulsions have narrow grain-size distribution i.e. at least about 95% by weight of the silver halide grains have a diameter which is within about 40%, preferably within about 30% of the mean grain diameter. As is known in the art, such emulsions can be prepared according to the double-jet precipitation technique, by simultaneous addition of a water-soluble halide e.g. an alkali metal halide such as potassium bromide and a water-soluble silver salt e.g. silver nitrate to an aqueous solution of a silver halide peptizer e.g. gelatin. Precipitation occurs under controlled pH, pAg and temperature conditions. These three factors are interdependent which means that for a given temperature, the pH and pAg should be adapted to each other to obtain uniform grain size.

Heterodispersed silver halide emulsions can be characterized as having wide grain-size distribution i.e. at least 10%, preferably at least 20% by weight of the silver halide grains have a diameter which for at least 40% deviates from the mean grain diameter. These emulsions can be prepared by methods generally known in the art. According to a very simple method, an aqueous silver salt solution e.g. aqueous silver nitrate is added to an aqueous solution of silver halide peptizer e.g. gelatin and halide(s), e.g. alkalimetal halide(s). The desired average grain size and grain-size distribution can be realised in known manner by the use of excess halide and can be modified as described by appropriate conditions, especially time and temperature, of physical ripening.

The silver halide grains of the direct-positive silver halide emulsions to be mixed are surface-fogged according to methods well known in the art. The emulsions may be fogged e.g. by an overall exposure to actinic radiation or by reduction sensitization e.g. by high ph and/or low pAgsilver halide precipitating or digestion conditions e.g. as described by Wood, J.Phot Sci. 1 (1953) 163, or by treatment with reducing agents. Fogging may also occur by reduction sensitization in the presence of a compound of a metal more electropositive than silver.

Reducing agents suitable for use include hydrazine, hydroxylamine, tin(II) compounds e.g tin(II) chloride, tin complexes and tin chelates of the (poly)amino(-poly)carboxylic acid type as described in British Pat. No. 1,209,050 filed Dec. 27, 1967 by Agfa-Gevaert N.V., ascorbic acid, formaldehyde, thiourea dioxide, polyamines such as diethylene triamine, phosphonium salts such as tetra(hydroxymethyl)phosphonium chloride, bis(p-aminoethyl)sulphide and its water-soluble salts, etc. Preferred reducing agents are thiourea dioxide and tin(II)chloride.

The compounds of a metal more electropositive than silver include gold compounds e.g. gold(III)chloride, potassium chloroaurate, potassium chloroaurite, and potassium aurithiocyanate, as well as compounds of rhodium, platinum, iridium, and palladium e.g. ammonium hexachloropalladate and potassium chloroiridate. Preferred noble metal compounds are gold compounds.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range This degree of fogging depends, as is known in the art, on the concentration of the fogging agents used as well as on the pH, the pAg, the temperature and the duration of the fogging treatment. Fogging of the silver halide grains is preferably effected at neutral or higher pH-values e.g. a pH-value of at least 6.5 and at a pAg-value below 8.35, preferably below 7.7.

High photographic sensitivities are obtained at low degrees of fogging as is illustrated in U.S. Pat. No. 3,501,307 of Bernard D. Illingsworth issued Mar. 17, 1970 and Belgian Pat. No. 795,121 filed Feb. 8, 1973 by Agfa-Gevaert N.V Thus, the degree of fogging can be adapted according to the requirements of desired sensitivity and the terms fogged and fogging as used herein are therefore employed in a very broad sense so that the very low degrees of fogging as defined in U.S. Pat. No. 3,501,307 and Belgian Pat. No. 795,336 both as mentioned hereinbefore are also embraced. This means that fogging is effected to such extent that a test portion of the fogged emulsions when coated on a support at a coverage of 0.50 to 5.50 g of silver per sq.m, gives a density of at least 0.50 upon processing for 3 min at 20° C in a developer of the following composition:

| | |
|---|---|
| hydroquinone | 15 g |
| 1-phenyl-3-pyrazolidinone | 1 g |
| trisodium salt of EDTA | 1 g |
| anhydrous sodium carbonate | 30 g |
| anhydrous sodium sulphite | 70 g |
| 40 % aqueous sodium hydroxide | 16 ml |
| water to make | 1 liter (pH : 11) |

One or more of the direct-positive silver halide emulsions to be blended in accordance with the method of the present invention may be of the type comprising interior electron traps i.e. silver halide emulsions containing silver halide grains having in their interior centres promoting the deposiition of photolytic silver. These emulsions are known in the art and can be prepared e.g. as described in British Pat. Nos. 1,011,062 filed May 15, 1962 by Kodak Ltd., 1,027,146 filed Aug. 30, 1963 by Agfa AG, 1,151,781 filed Apr. 15, 1966 by Kodak Ltd. and 1,306,801 filed April 2, 1969 by Agfa-Gevaert AG, in Belgian Pat. No. 763,827 filed Mar. 5, 1971 by Gevaert-Agfa N.V. and in German Patent Application No. 22 18 009 filed Apr. 14, 1972 by Agfa-Gevaert AG.

For this purpose, a monodispersed or heterodispersed fine-grain silver halide emulsion can be made first and the fine-grains are then used as cores for the silver halide grains of the ultimate emulsion.

The silver halide cores thus formed are then treated so as to produce centres that promote the deposition of photolytic silver (electron traps) on the cores. The cores may be treated chemically or physically according to any of the known procedures for producing ripening nuclei i.e. latent image nucleating centres. Such procedures are described e.g., by A. Hautot and H. Sauvenier in Sci. et Ind.Phot., Vol.XXVIII, January 1957, p.1–23 and 57–65.

The ripening nuclei can be formed by chemical sensitization by means of noble metal compounds, especially gold or iridium compounds, by means of sulphur compounds, e.g. thiosulphate, or by means of both noble metal compounds and sulphur compounds. Suitable compounds are e.g. alkali metal salts of the following noble metal ions: $[Au(S_2O_3)_2]^{3-}$, $[Au(SCN)_2]^-$, $[IrX_6]^{3-}$ and $[IrX_6]^{4-}$ wherein X is halogen e.g. chlorine.

Ripening of the silver halide cores can also be effected by means of reducing agents e.g. hydrazin, thiourea dioxide or tin(II)chloride, optionally together with noble metal compounds.

The ripening nuclei can further be provided by treating the silver halide cores with aqueous solutions of salts of polyvalent metals e.g. of the trivalent bismuth.

It is also possible to use the compounds suitable for the formation of the centres promoting the deposition of photolytic silver e.g. the chemical sensitizers referred to hereinbefore, during the precipitation of the fine-grain silver halide i.e. during the formation of the cores for the ultimate silver halide emulsion. In this way, the said centres are distributed statistically in the interior of the cores contrary to when the compounds are added after the formation of the fine-grain silver halide where the said centres are formed substantially at the surface of the cores. After the formation of the cores having centres promoting the deposition of photolytic silver, silver halide precipitation is continued to form around the cores an outer shell of silver halide. The "covered-grain" emulsion obtained is then surface fogged as described above.

In the preparation of the direct-positive photographic silver halide emulsions for use in accordance with the method of the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof, such as esters, amides and salts thereof etc. of synthetic hydrophilic resins; e.g. polyvinyl alcohol and poly-N-vinyl pyrrolidone, acrylamide polymers, cellulose ethers, partially hydrolyzed cellulose acetate and the like.

In addition to the hydrophilic binding agents other synthetic binding agents can be employed in the emulsions e.g. homo- and copolymers of acrylic and methacrylic acid or derivatives thereof e.g. esters, amides and nitriles, and vinyl polymers e.g. vinyl esters and vinyl ethers.

Spectrally sensitizing dyes which are not electron-accepting may be present in the emulsion blend, e.g. cyanines, merocyanines, complex (trinuclear) cyanines, complex (trinuclear) merocyanines, styryls and hemicyanines. These spectral sensitizers are preferably added together with the electron-acceptor or halogen-conducting compound.

Further colour couplers may be present in the blends of direct-positive emulsions of the present invention. Particularly suitable are colour couplers showing a low halogen-accepting character, which can be determined by the test described by R.P. Held in Phot.Sci.Eng.Vol. 11 (1967) p.406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through halogen acceptance by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct-positive photographic silver halide emulsions according to any suitable technique known to those skilled in the art for incorporating colour couplers in silver halide emulsions. For example, water-soluble colour couplers, e.g. those containing one or more sulpho or carboxyl groups (in acid or salt form), can be incorporated from an aqueous solution, if necessary, in the presence of alkali, and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent is removed afterwards by evaporation.

The silver halide emulsion layer and any other hydrophilic colloid layer, which may be present in a direct-positive photographic material employed in accordance with the present invention, may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides, vinylsulphones, etc.

The direct-positive photographic silver halide elements may further contain in the emulsion layer or other water-permeable colloid layers, antistatic agents, wetting agents as coating aids, e.g. saponin and synthetic surface-active compounds, plasticizers, matting agents, e.g. starch, silica, polymerhyl methacrylate, zinc oxide, titanium dioxide, etc., speed-increasing compounds, antifoggants and emulsion stabilizers, optical brightening agents including stilbene, triazine, oxazole and coumarin brightening agents, light-absorbing materials and filter dyes, mordanting agents for anionic compounds, etc.

The blend of direct-positive silver halide emulsions can be coated on one or both sides of a wide variety of supports which include opaque supports, e.g. paper and metal supports as well as transparent supports, e.g. glass, cellulose nitrate film, cellulose acetate film, cellulose aceto-butyrate film, polyvinylacetal film, polystyrene film, polyethylene terephthalate film, polycarbonate film and other films of resinous materials.

It is also possible to employ paper coated with $\alpha$-olefin polymers, e.g. paper coated with polyethylene, polypropylene, ethylene-butylene copolymers etc.

Development of exposed photographic direct-positive silver halide elements comprising a layer of a blend of fogged silver halide emulsions prepared according to the method of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents. The exposed blend of direct-positive emulsions may be developed to produce direct-positive black-and-white images or they may be developed to produce direct-positive colour images by means of aromatic primary amino colour developing agents, more particularly the known p-phenylenediamine developing agents, in the presence of colour couplers, which are incorporated in the emulsion or in the developing composition.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

It may be advantageous to employ energetic developers, especially when the silver halide grains of the direct-positive silver halide emulsions have been fogged to a very low degree, e.g. to the extent described in Bernard D. Illingworth's U.S. Pat. No. 3,501,307 issued Mar. 17, 1970 or even to a lower extent as described in the Belgian Pat. No. 795,121 as mentioned above.

The high-energy may be obtained by properly alkalizing the developing composition (pH 9–12), by using relatively high concentrations of ingredients in the developer, by using high-energy developing agents or a combination of developing agents, which when used together are known to produce a superadditive effect, for example hydroquinone/1-phenyl-3-pyrazolidinone and hydroquinone/N-methyl-p-aminophenol sulphate, by addition to the developer of development accelerators, e.g. polyethylene glycol and other polyoxyalkylene compounds as well as quaternary ammonium or phosphonium compounds and ternary sulphonium compounds. For example, developing compositions can be used comprising per litre at least 5 g of hydroquinone and an auxiliary super-additive developing agent, e.g. 1-phenyl-3-pyrazolidinone and N-methyl-p-aminophenol sulphate the optimum concentration of which relative to the amount of hydroquinone can be determined by routine laboratory experiments.

As is described in Belgian Pat. No. 795,336 filed Feb. 13, 1973 by Agfa-Gevaert N.V.it may be advantageous to effect development of the exposed direct-positive silver halide emulsions with compositions substantially free from halide ions. Development with developing compositions substantially free from halide ions is particularly favourable in order to obtain high maximum densities for direct-positive silver halide emulsions the silver halide grains of which have been fogged to a very low degree, e.g. as described in U.S. Pat. No. 3,501,307 and Belgian Pat. No. 795,121 both as mentioned hereinbefore.

One or more developing agents may be incorporated in the direct-positive photographic element. They may be present in the silver halide emulsion layer itself and/or in another suitable location in the photographic element. Development can then be effected by means of an alkaline processing solution called development activator solution, which is substantially free of developing agents.

Where development is effected with compositions substantially free from halide ions, the processing solution used to effect development of the exposed direct-positive silver halide emulsion and which comprises or does not comprise one or more developing agents is preferably supplied in an amount that suffices for the treatment of exactly one piece of light-sensitive element. As a matter of fact, when the processing solution is used repeatedly for processing successive silver bromide-containing elements the processing solution inevitably becomes contaminated with alkaline bromide. Therefore it is preferred to use a single-use bath. A bath of this type offers the advantage that ageing and contamination of the bath composition are eliminated. For one-time use the processing solution is preferably relatively viscous so as to be easily controlled when spread. Viscous processing solutions can be obtained by addition of a thickening agent, for example a water-soluble polymer. The film-forming plastic may be any of the high molecular weight polymers that are stable to alkali and that are soluble in aqueous alkaline solutions e.g. hydroxyethylcellulose, starch or gum, polyvinyl alcohol, the sodium salts of polymethacrylic acid and polyacrylic acid, sodium alginate, sodium carboxymethyl cellulose etc. The relatively viscous processing composition may be confined within a container, which is ruptured at the moment of development as is done, for example, in the well-known silver complex diffusion transfer process for in-camera processing.

The following example illustrates the present invention.

EXAMPLE

Two direct-positive silver halide emulsions of different average grain-size and comprising fogged silver halide grains were prepared as follows.

Emulsion 1

A mono-disperse, cubic, direct-positive photographic chlorobromoiodide emulsion (85 mole % of chloride — 12.5 mole % of bromide and 2.5 mole % of iodide), having an average grain size of 0.15 μm, was prepared under controlled pH, pAg and temperature conditions during the precipitation of the silver halide. The pH was maintained at about 5.5, the pAg at 6.83 and the temperature at 60° C. The emulsion was chill-set, shredded and washed with cold water. At 40° C, gelatin and water were added in order to obtain a gelatin to silver nitrate ratio of 1.4 and a concentration of silver halide corresponding to 50 g of silver nitrate per kg of emulsion. The emulsion was then fogged by digestion for 90 min. at 57° C, pH 7 and pAg 6.16 in the presence of potassium chloroaurate (1.5 mg per mole of silver nitrate used in emulsion preparation).

Emulsion 2

A second emulsion was prepared in a similar way as emulsion I with the difference that on regular intervals during precipitation, a part of the emulsion equal to the volume added in the previous interval, was discarded. The deposition continued on the remaining crystals so that they grew more rapidly. The average grain size obtained was 0.5 μm. After washing, gelatin and water were added so as to obtain a gelatin to silver nitrate ratio of 1.4 and a concentration of silver halide corresponding to 50 g of silver nitrate per kg of emulsion. The emulsion was fogged by digestion for 70 min. at 57° C, pH 7 and pAg 6.5 in the presence of potassium chloroaurate (0.9 mg per mole of silver nitrate used in emulsion preparation).

The above emulsions were further treated and coated as described hereinafter to form photographic direct-positive silver halide elements.

Element A

To Emulsion 1 were added per mole of silver nitrate 500 mg of pinacryptol yellow and 400 mg of the spectral sensitizer with formula:

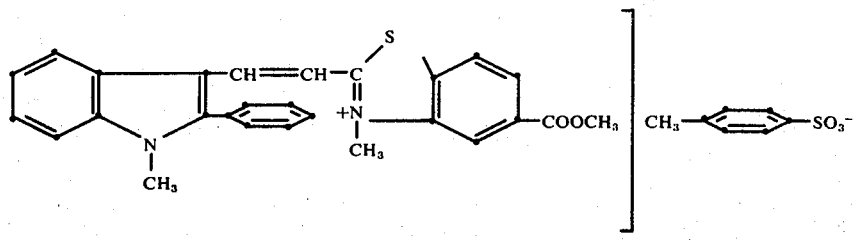

After 5 min. the pAg and the pH of the emulsion were adjusted to the values 9.6 and 5 respectively by means of potassium bromide and sulphuric acid.

The emulsion was coated on a conventional support at a coverage of 3.75 g of silver per sq.m. and dried.

Element B

To emulsion 2 were added per mole of silver nitrate 250 mg of pinacryptol yellow and 200 mg of the above spectral sensitizer. After 5 min. the pAg and pH of the emulsion were adjusted to the values 9.6 and 5 respectively by means of potassium bromide and sulphuric acid. The emulsion was coated on a conventional support at a coverage of 3.75 g of silver per sq.m. and dried.

Elements $C_1$ and $C_2$

To the emulsions 1 and 2 pinacryptol yellow and spectral sensitizer were added as described for elements A and B in the amounts given. The pH and pAg of both emulsions were adjusted to the values given 5 and 9.6 respectively by means of potassium bromide and sulphuric acid.

Blends of equal parts by weight of the emulsions were then prepared and stirred at 45° C.

The emulsion blends were coated after 10 min. (Element $C_1$) and 30 min. (Element $C_2$) respectively on a conventional support at a coverage of 3.75 g of silver per sq.m. and dried.

Elements $D_1$ and $D_2$

To emulsion 1 were added per mole of silver nitrate 500 mg of pinacryptol yellow and 400 mg of the above spectral sensitizer per mole of silver nitrate.

To emulsion 2 were added per mole of silver nitrate 250 mg of pinacryptol yellow and 200 mg of the above spectral sensitizer per mole of silver nitrate.

Blends of equal parts by weight of the emulsions were then prepared and stirred at 45° C.

After 10 min. (Element $D_1$) and 30 min. (Element $D_2$) the pAg and pH of the emulsion blends were adjusted to the values 9.6 and 5 respectively by means of potassium bromide and sulphuric acid.

The emulsion blends were coated on a conventional support at a coverage of 3.75 g of silver per sq.m. and dried.

Element E

Equal parts by weight of emulsions 1 and 2 were blended together whereupon 375 mg of pinacryptol yellow and 300 mg of the above spectral sensitizer were added per mole of silver nitrate.

After 5 min., the pH and the pAg of the emulsion blend were adjusted to the values 5 and 9.6 respectively by means of potassium bromide and sulphuric acid.

The emulsion blend was coated on a conventional support at a coverage of 3.75 g of silver per sq.m. and dried.

Element F (Comparison Element)

Equal parts by weight of emulsions 1 and 2 were blended together. The pAg and pH of the emulsion blend were then adjusted to the values 9.6 and 5 respectively by means of potassium bromide and sulphuric acid.

The emulsion blend was stirred for 10 min. at 45° C whereupon 375 mg of pinacryptol yellow and 300 mg of the above spectral sensitizer were added per mole of silver nitrate.

The emulsion blend was coated on a conventional support at a coverage of 3.75 g of silver per sq.m. and dried.

Elements A, B, $C_1$, $C_2$, $D_1$, $D_2$, E and F were exposed in a sensitometer, developed at 20° C for 5 min in a hydroquinone-formaldehyde bisulphite "lith"-developer and then fixed, washed and dried in the usual way. The sensitometric results attained are listed in the following table. The values given for the speed for relative values for the speed measured at density 0.2 below maximum density; a value of 100 was given to the speed of element A.

Table

| element | D min | D max | relative speed |
|---|---|---|---|
| A | 0.04 | > 4 | 100 |
| B | 0.05 | 2.94 | 219 |
| $C_1$ | 0.05 | 3.18 | 263 |
| $C_2$ | 0.06 | 2.96 | 289 |
| $D_1$ | 0.06 | 3.83 | 151 |
| $D_2$ | 0.05 | 3.76 | 126 |
| E | 0.04 | 3.71 | 200 |
| F | 0.03 | 0.35 | — |

The above results clearly show that in order to obtain emulsion blends of satisfactory sensitometric characteristics the silver halide grains should be provided at the surface thereof with the electron-acceptor before increasing the pAg (compare results of elements $C_1$–$C_2$, $D_1$–$D_2$ and E with those of element F). Highest maximum densities are obtained when the pAg is raised after blending of the separate emulsions (elements $D_1$, $D_2$ and E) whereas highest speed is obtained when the pAg is raised before blending (elements $C_1$ and $C_2$).

We claim:

1. Method of making a direct-positive photographic silver halide material which comprises a support and a layer of an emulsion blend having a pAg value of at least 8.35, by the steps of:

1. preparing two or more direct-positive silver halide emulsions of different average grain-sizes comprising fogged silver halide grains and having pAg values below 8.35, wherein one direct-positive silver halide emulsion of the blend has an average grain size of at least 50% greater than another emulsion of the blend,
2. raising the pAg values of the separate emulsions to a value of at least 8.35 and subsequently blending the emulsions or blending the separate emulsions and subsequently raising the pAg of the emulsion blend to a value of at least 8.35,
3. providing at least one halogen conducting or electron-accepting compound at the surface of the fogged silver halide grains prior to raising the pAg value to a value of at least 8.35, and
4. coating on a support layer of the emulsion blend having a pAg value of at least 8.35.

2. Method according to claim 1, wherein the separate direct-positive silver halide emulsions to be blended are provided at the surface of the fogged silver halide grains with at least one electron-accepting or halogen-conducting compound whereupon the pAg-values of the separate emulsions are raised to the value of at least 8.35 and the emulsions are then mixed to form the emulsion blend.

3. Method according to claim 1, wherein the separate direct-positive silver halide emulsions to be blended are provided at the surface of the fogged silver halide grains with at least one electron-accepting or halogen-conducting compound, whereupon the emulsions are mixed to form an emulsion blend and the pAg of the emulsion blend is raised to the value of at least 8.35.

4. Method according to claim 1 comprising the steps of blending two or more direct-positive silver halide emulsions of different average grain-sizes comprising fogged silver halide grains and having pAg values below 8.35, providing at least one electron-accepting or halogen-conducting compound at the surface of the fogged silver halide grains of the emulsion blend and raising the pAg of the emulsion blend to the value of at least 8.35.

5. Method according to claim 1, wherein the emulsions to be blended have pAg values in the range from about 5 to about 7.7.

6. Method according to claim 1, wherein the pAg is raised to a value in the range from about 9 to about 11.

7. Method according to claim 1, wherein raising the pAg occurs by addition of a compound, yielding bromide and/or iodide ions in aqueous medium.

8. Method according to claim 1, wherein in addition to raising the pAg, the pH is lowered to a value below 6.5.

9. Method according to claim 1, wherein the silver halide grains of the separate emulsions have been fogged by reduction sensitization.

10. Method according to claim 9, wherein the reduction sensitization occurs in the presence of a compound of a metal more electropositive than silver.

11. Method according to claim 1, wherein the surface of the fogged silver halide grains are provided with an electron-accepting compound and a spectrally sensitizing dye.

12. Method according to claim 11, wherein the electron accepting compound is a nitrostyryl or nitrobenzylidene dye.

* * * * *